US007931501B1

(12) United States Patent
Chiang

(10) Patent No.: US 7,931,501 B1
(45) Date of Patent: Apr. 26, 2011

(54) ELECTRICAL CONNECTOR

(75) Inventor: Shu-Man Chiang, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/815,400

(22) Filed: Jun. 15, 2010

(51) Int. Cl.
*H01R 13/648* (2006.01)

(52) U.S. Cl. ..... 439/607.35; 439/607.01; 439/660

(58) Field of Classification Search ..... 439/607.35, 439/607.01, 607.39, 607.54, 660, 607.4
See application file for complete search history.

(56) References Cited

U.S. PATENT DOCUMENTS 6,267,624 B1 * 7/2001 Wu et al. ..... 439/607.35
6,705,893 B1 * 3/2004 Ko ..... 439/607.56
7,331,822 B2 * 2/2008 Chen n ..... 439/607.01
7,753,729 B2 * 7/2010 Wang ..... 439/607.01
2005/0095913 A1 * 5/2005 Fan ..... 439/607
2007/0173118 A1 * 7/2007 Chen ..... 439/607
2007/0270034 A1 * 11/2007 Belopolsky et al. ..... 439/607
2010/0317220 A1 * 12/2010 Shen ..... 439/374

* cited by examiner

*Primary Examiner* — Gary F. Paumen

(57) ABSTRACT

An electrical connector includes an insulating housing, a plurality of terminals and a shielding shell. The insulating housing has a base body and a tongue. Two sides of the front surface of the base body define two inserting slots. A propping portion is perpendicularly connected between two face-to-face insides of the inserting slot. The terminals are disposed in the insulating housing respectively. The shielding shell is mounted to the insulating housing, and has a tongue sheath with two side plates. A rear edge of each side plate extends rearward to form a fastening piece with a clipping opening. Two opposite edges of the clipping opening are further concaved oppositely to form a locating opening. The tongue sheath is sleeved around the tongue. The fastening piece is inserted rearward into the corresponding inserting slot, and the propping portion slides along the clipping opening until being buckled into the locating opening.

5 Claims, 3 Drawing Sheets

ELECTRICAL CONNECTOR

BACKGROUND OF THE INVENTION

1. Field of the Invention

The present invention relates to an electrical connector, and more particularly to an electrical connector having a shielding shell capable of being assembled thereto tightly.

2. The Related Art

A traditional electrical connector generally includes an insulating housing and a shielding shell having two fastening pieces extended from two sides thereof. Conventionally, the two sides of the insulating housing are concaved inward to form two fastening grooves. The shielding shell is assembled to the insulating housing by means of fastening the fastening pieces in the corresponding fastening grooves of the insulating housing.

However, the shielding shell may not be firmly fastened by means of the above-mentioned assembling structure. A deformation of the fastening piece of the shielding shell is apt to be caused by an improper external force. As a result, the shielding shell easily falls off from the insulating housing that will affect a performance of the electrical connector.

SUMMARY OF THE INVENTION

An object of the present invention is to provide an electrical connector. The electrical connector includes an insulating housing, a plurality of terminals and a shielding shell. The insulating housing has a base body and a tongue protruding forward from a front surface of the base body. Two sides of the front surface of the base body define two inserting slots longitudinally extending rearward and adjacent to two opposite sides of the tongue. A propping portion is perpendicularly connected between two face-to-face inside portions of the inserting slot. The terminals are disposed in the insulating housing respectively. The shielding shell is mounted to the insulating housing, and has a tongue sheath with two side plates. A rear edge of each side plate extends rearward to form a fastening piece with a clipping opening extending longitudinally to pass through a rear end of the fastening piece. Two portions of two opposite edges of the clipping opening are further concaved oppositely to form a locating opening. The tongue sheath is sleeved around the tongue of the insulating housing. The fastening piece is inserted rearward into the corresponding inserting slot. And the propping portion slides along the clipping opening until being buckled into the locating opening.

As described above, the fastening piece of the shielding shell is inserted in the inserting slot of the insulating housing, and the propping portion is buckled in the locating opening, so that can avoid the shielding shell falling off from the insulating housing under an improper external force and further fasten the shielding shell to the insulating housing firmly.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
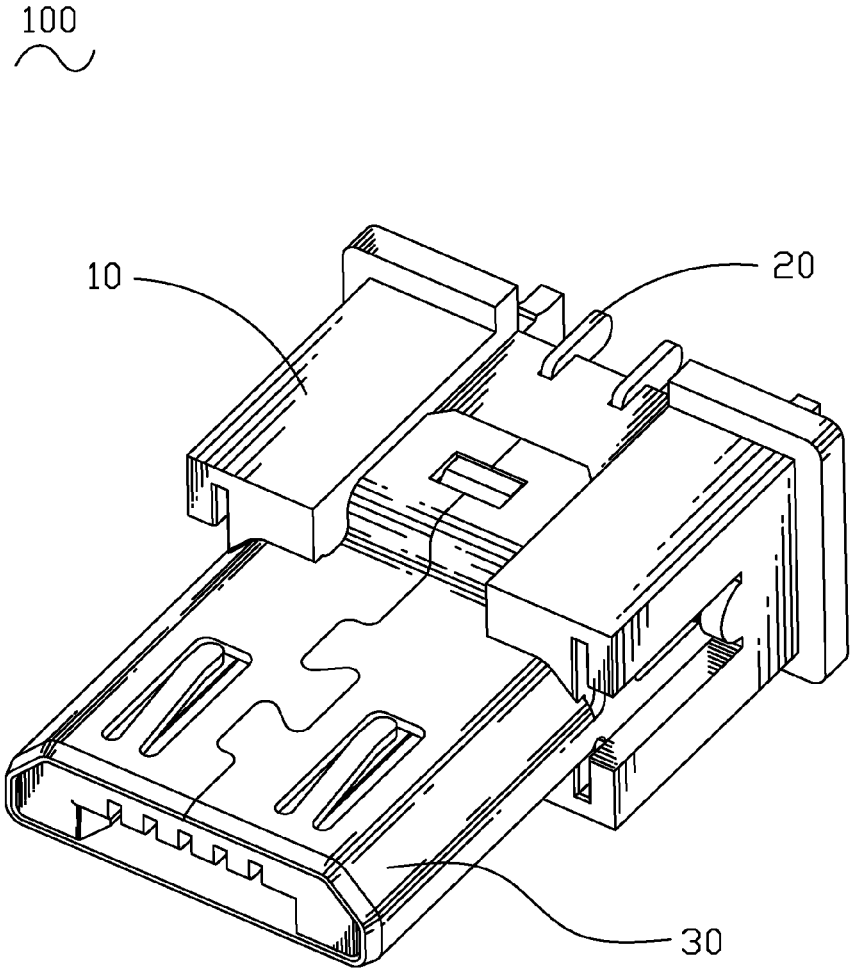
FIG. 1 is a perspective view of an electrical connector according to the present invention.

Referring to FIG. 1, an electrical connector 100 according to the present invention includes an insulating housing 10, a plurality of terminals 20 and a shielding shell 30 mounted to the insulating housing 10 respectively.

Figure 2:
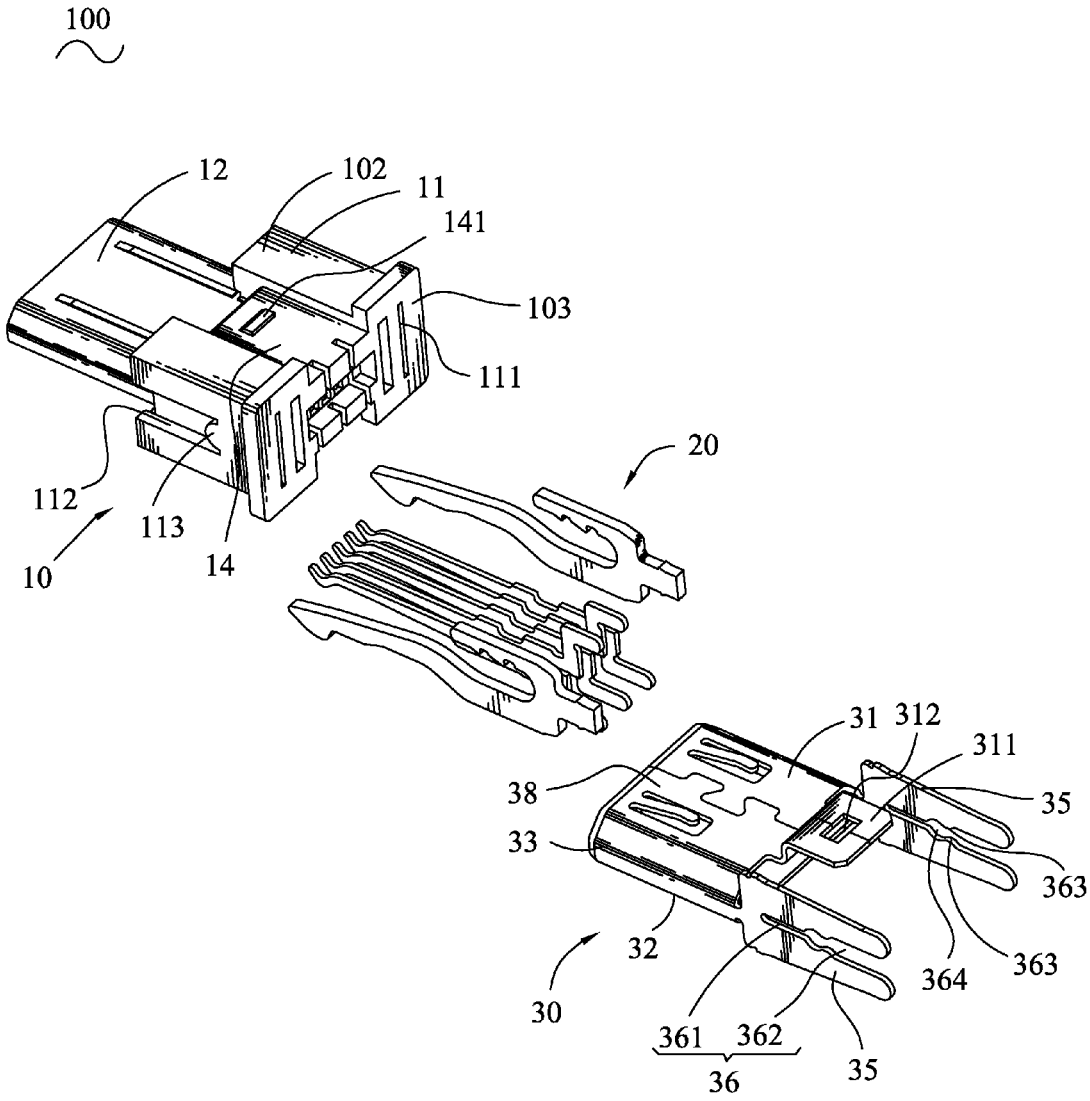
FIG. 2 is an exploded view of the electrical connector of FIG. 1.
Figure 3:
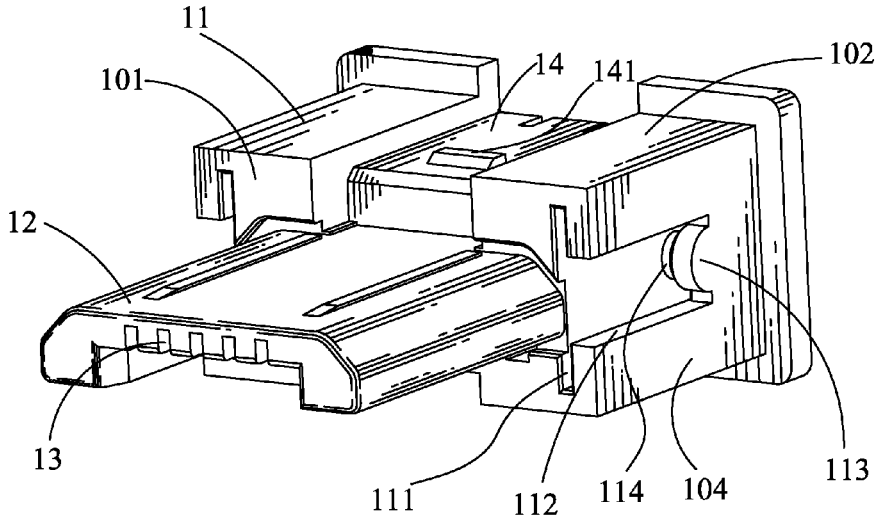
FIG. 3 is a perspective view of an insulating housing of the electrical connector of FIG. 1.

Referring to FIG. 2 and FIG. 3, the insulating housing 10 has a base body 11 of a substantially rectangular shape. The base body 11 has a front surface 101, a top surface 102 perpendicular to the front surface 101, a rear surface 103 opposite to the front surface 101 and two opposite side surfaces 104. A tongue 12 is protruded forward from a middle of the front surface 101 of the base body 11. A plurality of terminal grooves 13 are opened in a bottom of the tongue 12, and each extends longitudinally to pass through the base body 11. Two sides of the front surface 101 define two inserting slots 111 extending longitudinally to pass through the rear surface 103, and adjacent to two opposite sides of the tongue 12 and the two side surfaces 101, respectively. Each side surface 104 defines an opening 112 connected with a middle of an outside of the corresponding inserting slot 111 and passing through the front surface 101. A middle of a rear face of the opening 112 protrudes forward into the opening 112 to form a semicircular locating portion 113. A columned propping portion 114 is perpendicularly connected between a middle of an inside of the locating portion 113 and a portion of an inside of the inserting slot 111 facing the middle of the inside of the locating portion 113. An indentation 14 is opened in a middle of the top surface 102 along the front-to-rear direction. A portion of a bottom face of the indentation 14 protrudes upward to form a buckling portion 141.

Figure 4:
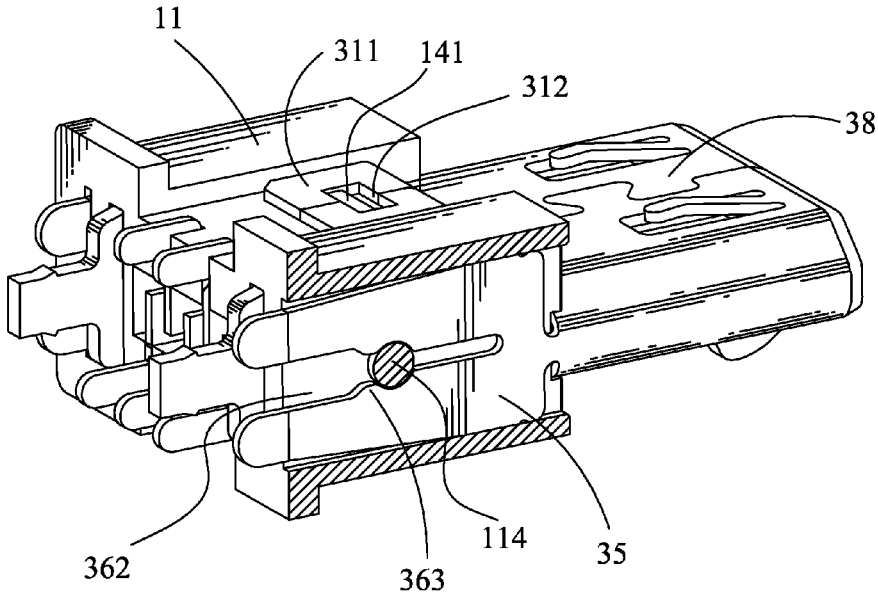
FIG. 4 is a sectional view of the electrical connector of FIG. 1.

Referring to FIG. 2 and FIG. 4, the shielding shell 30 has a rectangular tongue sheath 38 with a top plate 31, a bottom plate 32 and two side plates 33. A middle of a rear edge of the top plate 31 is bent upward, and then extends rearward to form a buckling piece 311 of which a middle defines a buckling hole 312. A rear edge of each side plate 33 extends rearward to form a substantially scissors-shaped fastening piece 35 with a clipping opening 36 extending longitudinally to pass through a rear end of the fastening piece 35. The clipping opening 36 includes a first opening 361 at a front thereof and a second opening 362 at a rear thereof. The second opening 362 is wider than the first opening 361. A pair of guiding slopes 363 is formed at the junction of the first opening 361 and the second opening 362. A top edge and a bottom edge of a rear of the first opening 361 are further concaved oppositely to form a locating opening 364 adjacent to the guiding slopes 363.

Referring to FIGS. 1-4, the terminals 20 for receiving and transmitting signals are molded in the terminal grooves 13 of the insulating housing 10. The tongue 12 of the insulating housing 10 is inserted into the tongue sheath 38 of the shielding shell 30. The buckling piece 311 is received in the indentation 14 with the buckling portion 141 being buckled in the buckling hole 312. In a process of assembling the shielding shell 30 to the insulating housing 10, the fastening pieces 35 are inserted rearward into the inserting slots 111 respectively, the propping portions 114 slide into the corresponding locating openings 364 through the guiding slopes 363, and then are buckled in the corresponding locating openings 364.

As described above, the fastening piece 35 of the shielding shell 30 is inserted in the inserting slot 111 of the insulating housing 10, and the propping portion 114 is buckled in the locating opening 364, so that can avoid the shielding shell 30 falling off from the insulating housing 10 under an improper external force and further fasten the shielding shell 30 to the insulating housing 10 firmly.

What is claimed is:

1. An electrical connector, comprising:

an insulating housing having a base body and a tongue protruding forward from a front surface of the base body, two sides of the front surface of the base body defining two inserting slots longitudinally extending rearward and adjacent to two opposite sides of the tongue, a propping portion being perpendicularly connected between two face-to-face inside portions of each inserting slot;

a plurality of terminals disposed in the insulating housing respectively; and a shielding shell mounted to the insulating housing, and having a tongue sheath with two side plates, a rear edge of each side plate extending rearward to form a fastening piece with a clipping opening extending longitudinally to pass through a rear end of the fastening piece, two portions of two opposite edges of the clipping opening being further concaved oppositely to form a locating opening, wherein the tongue sheath is sleeved around the tongue of the insulating housing, the fastening piece is inserted rearward into the corresponding inserting slot, and the propping portion slides along the clipping opening until being buckled into the locating opening.

2. The electrical connector as claimed in claim 1, wherein the clipping opening includes a first opening at a front thereof, and a second opening at a rear thereof wider than the first opening, a pair of guiding slopes is formed at the junction of the first opening and the second opening, the locating opening is formed in a rear of the first opening and adjacent to the guiding slopes, the propping portion slides along the second opening until being buckled into the locating opening through the guiding slopes.

3. The electrical connector as claimed in claim 1, wherein each side surface of the base body of the insulating housing defines an opening connected with a middle of the inserting slot, a middle of a rear face of the opening protrudes forward into the opening to form a locating portion, the propping portion is perpendicularly connected between a middle of an inside of the locating portion and a portion of an inside of the inserting slot facing the middle of the inside of the locating portion.

4. The electrical connector as claimed in claim 1, wherein the tongue sheath of the shielding shell has a top plate of which a portion of a rear edge is bent upward, and then extends rearward to form a buckling piece, an indentation is opened longitudinally in a top surface of the base body of the insulating housing for buckling the buckling piece therein.

5. The electrical connector as claimed in claim 4, wherein a buckling portion is protruded upward from a bottom face of the indentation, the buckling piece defines a buckling hole for buckling the buckling portion therein.

* * * * *